United States Patent [19]

Kling

[11] 3,992,288

[45] Nov. 16, 1976

[54] METHOD OF SEPARATING ARTICLES HAVING DIFFERENT SPECIFIC GRAVITIES

[75] Inventor: Harry C. Kling, Boxford, Mass.

[73] Assignee: International Telephone and Telegraph Corporation, Nutley, N.J.

[22] Filed: Nov. 21, 1975

[21] Appl. No.: 634,309

Related U.S. Application Data

[63] Continuation-in-part of Ser. No. 557,205, March 10, 1974, abandoned.

[52] U.S. Cl. ..... 209/3; 209/10; 209/172; 204/1 T

[51] Int. Cl.[2] ..... B03B 1/00

[58] Field of Search ..... 209/1–4, 209/10, 11, 172, 173; 29/574, 583, 580; 204/1 T, 15, 16, 129.1, 129.2, 129.65

[56] References Cited

UNITED STATES PATENTS

| | | | |
|---|---|---|---|
| 2,150,917 | 3/1939 | Foulke et al. | 209/172 |
| 2,896,922 | 7/1959 | Pohlman | 209/1 X |
| 3,347,370 | 10/1967 | Rampacek et al. | 209/172 |
| 3,379,625 | 4/1968 | Csabi | 204/1 T |
| 3,384,279 | 5/1968 | Grechus | 29/580 X |
| 3,543,393 | 12/1970 | Cosper et al. | 29/583 |
| 3,710,932 | 1/1973 | Bodine | 209/1 |

FOREIGN PATENTS OR APPLICATIONS

| | | | |
|---|---|---|---|
| 4,521,537 | 7/1970 | Japan | 209/2 |

*Primary Examiner*—Frank W. Lutter
*Assistant Examiner*—Ralph J. Hill
*Attorney, Agent, or Firm*—John T. O'Halloran; Peter C. Van Der Sluys

[57] ABSTRACT

Articles having a first specific gravity may be separated from articles having a second specific gravity by placing said articles in an environment having a specific gravity between the specific gravities of the articles to be separated and thereafter subjecting the articles to pressure waves preferably of an ultrasonic frequency and having an intensity sufficient to initiate movement of said articles in the environment. The articles with the high specific gravity migrate downwardly while the lower specific gravity articles migrate upwardly to the surface where they may be removed.

10 Claims, No Drawings

METHOD OF SEPARATING ARTICLES HAVING DIFFERENT SPECIFIC GRAVITIES

CROSS-REFERENCE TO RELATED APPLICATIONS

This application is a continuation-in-part of U.S. patent application Ser. No. 557,205, filed Mar. 10, 1974, now abandoned.

BACKGROUND OF THE INVENTION

1. Field of the Invention

The present invention relates to the separation of articles having different specific gravities and more particularly to a method for separating defective semiconductor devices.

2. Description of the Prior Art

The identification and separation of defective semiconductor devices has long been a problem in the semiconductor manufacturing field and many solutions have been proposed.

A substantial portion of the cost of a finished semiconductor device is attributable to the cost of packaging and therefore substantial losses are experienced when defective devices are packaged. It is most important that defective devices be identified and removed prior to packaging so as to reduce the overall cost of manufacturing.

Several methods have been developed for identifying and removing defective devices. Test equipment has been developed for identifying defective devices wherein an entire wafer having many devices formed thereon may be tested. The defective devices may be marked for subsequent removal after the wafer is scribed and broken into separate dice.

Heretofore, the defective devices on a wafer have been hand marked with an identifying material such as ink so that the defective devices may be manually removed after the wafer is broken into individual dice. In an advanced system, the defective devices were marked with a magnetic ink so that they may be subsequently segregated by passing the dice beneath a magnet which would attract and pick up the defective dice having the magnetic ink marking.

In a more sophisticated system that eliminates the need for hand marking of the defective devices, the semiconductor wafer is placed in a deplating solution and subjected to an electric potential that reverse biases the PN junctions in the devices. Thus, defective devices that are shorted or have excessive leakage will have their metal contacts deplated. Deplating of the metal contacts from the defective devices effectively reduces the specific gravity of the die on which the device is formed since the heavier metal is removed and only the lighter silicon remains.

After the deplated wafer is scribed and broken into individual dice, the dice are poured into a tubular container filled with a bromoform solution having a specific gravity adjusted to a level between that of the silicon dice and the dice having metal contacts. Theoretically, the deplated dice would float in the bromoform solution while the heavier dice having metal contacts would sink to the bottom of the tubular container. The method did not meet with practical success since circulating currents tend to develop in the bromoform solution so that some heavy dice would be carried to the surface by the circulating currents. Thus, the prior art method resulted in excessive numbers of acceptable devices being discarded and defective devices escaping detection.

SUMMARY OF THE INVENTION

The present invention contemplates a method for separating articles having different specific gravities wherein the problems encountered in the prior art are eliminated through the unique use of pressure waves or vibrations preferably of an ultrasonic frequency to assist in separating the articles. The articles are placed in an environment having a specific gravity between the specific gravities of the articles to be separated and are thereafter subjected to pressure waves having an ultrasonic frequency and having an intensity sufficient to establish movement of the articles so that the heavier articles sink while the lighter articles migrate to the surface. The lighter articles may thereafter be removed from the surface of the environment.

The present invention will be described as a method for separating defective semiconductor devices; however, it is to be understood that the invention is not limited to use with semiconductor devices but may be used for the separation of any type articles having different specific gravities. In the preferred embodiment, the environment into which the articles are placed is a liquid; however, the present invention will work using an environment that has a powdery or particulate consistency.

The primary objective of the present invention is to provide an improved method for separating articles having different specific gravities.

Another objective of the present invention is to provide a method that produces improved yields and requires less time for the articles to become separated.

When the present invention is applied to the separation of semiconductor devices other important advantages are realized. Semiconductor dice with weak contacts are identified and separated. When the dice with weak contacts are subjected to the pressure waves the weak contacts break off, thereby reducing the specific gravity of the defective dice and causing them to float. Small silicon chips and other debris will also tend to float to the surface where they may be removed.

Other objects and advantages of the present invention will become apparent from the following description which describes the process of the present invention.

DESCRIPTION OF THE PREFERRED PROCESS

Semiconductor wafers having a plurality of semiconductor devices formed thereon may be tested in various known ways to identify defective devices. The defective devices may be visually identified and manually marked with a material such as an ink or varnish containing a heavy substance having a specific gravity greater than the specific gravity of the die on which the semiconductor device is formed. Thus, the hand marked dice will have a specific gravity higher than the unmarked dice.

Alternatively, the specific gravity of the dice on which the defective devices are formed may be altered by deplating the metal contacts from the device. This process is particularly useful for devices having plated contacts such as silver or other standard contact metals. The entire wafter is submerged in a deplating solution and a potential is applied to the wafer so as to reverse bias the semiconductor junctions within the devices on the wafer so that shorted or leaky junctions will pass a current causing the associated contacts to be deplated. By removal of the contact metal from the defective semiconductor devices, the specific gravity of the dice on which the devices are formed is reduced.

After the specific gravity of the dice on which the defective devices are formed has been altered either by inking with a heavy material or deplating as previously described, the wafers are scribed and broken into a plurality of dice. The separated dice are first passed through a screen of a predetermined mesh size to remove groups of dice that have not been properly separated.

A flotation solution is prepared so as to have a specific gravity between that of the defective and non-defective dice. For dice having silver contacts, a flotation solution was prepared using 160 cc of xylene and 600 ml of bromoform, $CHBr_3$. Approximately 200 ml of the flotation solution is poured into a stainless steel beaker and thereafter the screened dice are introduced into the flotation solution. The beaker containing the flotation solution and the dice are then placed in an ultrasonic tank and subjected to ultrasonic vibrations for approximately 1 minute. The ultrasonic vibrations cause pressure waves in the flotation solution which act upon the dice to cause physical movement, thereby enhancing separation.

It is essential that the pressure waves act upon the dice and not merely vibrate the liquid as would occur if low frequency sonic vibrations were used. A wide range of frequencies may be used successfully but lower frequencies require larger size vessels and would also be disturbing to humans if they fell within the audible range. Thus, for practical applications and minimum human discomfort, it is preferred that an ultrasonic frequency be used.

The required intensity for the pressure waves varies considerably and depends upon the mass of the dice since it is essential that the waves impart a physical movement to the dice. If too high an intensity is used, cavitation of the solution will occur and the dice will be mixed rather than separated. The preferred method is to increase wave intensity until a physical movement is noticeable. This intensity will usually result in a slight ripple on the surface of the liquid.

In one example the dice were placed in a beaker with 200 ml of the previously mentioned solution and the beaker was placed in a Branson Instruments, Model EMA-30-B ultrasonic tank and subjected to ultrasonic energy of about 210 watts at a frequency of approximately 40 KHz which was sufficient to start separation of the dice. The ultrasonic signal was continued for a period of about one minute to assure complete separation of the dice.

After the ultrasonic pressure waves are terminated, a brief period of approximately one minute should be allowed for the solution to stabilize with the heavy dice settled down and the defective dice floating. The flotation solution is then decanted to remove any defective dice and floating particles. Preferably, this procedure should be repeated two or more times to be certain that all of the defective dice and debris are removed.

After the final decanting of the defective dice, the remaining dice are rinsed with xylene. The dice are then submerged into trichloroethylene and heated to a slow rolling boil after which the solvent is decanted and the procedure is preferably repeated two more times. The dice are then submerged in methanol and heated to a slow rolling boil after which the solvent is decanted and the procedure is preferably repeated two more times. The dice are then oven dried at a temperature of approximately 120° to 130+ C.

The dice are now ready for additional standard processing, testing and packaging which steps are not a part of the present invention.

Thus, the present invention provides a simplified and effective method for removing defective dice wherein the yield is substantially improved. By subjecting the dice and the flotation solution to an ultrasonic signal, better and more rapid separation is achieved and the problems associated with circulating currents are overcome. Other advantages realized through the unique use of an ultrasonic signal are that dice having weak contacts are also separated since the contacts break off when subjected to the ultrasonic signal. A substantial amount of debris including silicon chips is also removed during the separating and decanting process.

What is claimed is:

1. A method for separating defective and non-defective semiconductor dice which have different specific gravities, comprising the steps of:

preparing a solution having a specific gravity between the specific gravities of the defective and non-defective dice;

placing said dice in said solution;

subjecting said dice and said solution to ultrasonic pressure waves having an intensity sufficient to establish movement of said dice, whereby the dice having a specific gravity lower than that of the solution migrate to the surface of the solution and the dice having a specific gravity higher than the solution migrate to the bottom; and removing the dice having the lower specific gravity from the solution while the higher specific gravity dice remain at the bottom.

2. A method as described in claim 1 wherein removal of the lower specific gravity dice is accomplished by decanting said dice from the solution.

3. A method as described in claim 2, wherein the steps of subjecting the dice to the ultrasonic pressure waves and decanting are repeated at least twice.

4. A method as described in claim 1 wherein the solution is a bromoform solution.

5. A method as described in claim 1 wherein the non-defective dice have metal contacts and the defective dice have no contacts so that they have a lower specific gravity and the solution is a bromoform solution.

6. A method as described in claim 5 wherein the bromoform solution comprises xylene and bromoform at an approximate ratio of 160 cc of xylene to 600 ml of bromoform.

7. A method as described in claim 5, additionally comprising the steps of:

rinsing the non-defective dice with xylene;

boiling the rinsed dice in trichloroethylene;

boiling the dice in methanol; and drying said dice.

8. A method as described in claim 1, wherein the intensity of the ultrasonic pressure waves is increased until movement of the dice is initiated.

9. A method for identifying and separating defective semiconductor devices of the type wherein a plurality of devices are formed on a single semiconductor wafer, comprising the steps of:

testing the semiconductor wafer to identify and alter the specific gravity of dice on which defective devices are formed;

separating said wafer into dice each having at least one semiconductor device formed thereon;

placing said dice into a bromoform flotation solution having a specific gravity between the specific gravities of the good dice and the defective dice;

subjecting the dice and the flotation solution to an ultrasonic signal having an intensity sufficient to establish movement of said dice, so that said dice separate by floating and sinking; and removing the floating dice from the flotation solution.

10. A method as described in claim 9, wherein the specific gravity of the defective dice is altered by deplating metal contacts therefrom to reduce the specific gravity and cause the defective dice to float when placed in the flotation solution and subjected to an ultrasonic signal.

* * * * *